US007141148B2

(12) United States Patent
Julsrud et al.

(10) Patent No.: US 7,141,148 B2
(45) **Date of Patent: *Nov. 28, 2006**

(54) MATERIAL FOR A DIMENSIONALLY STABLE ANODE FOR THE ELECTROWINNING OF ALUMINUM

(75) Inventors: Stein Julsrud, Skien (NO); Turid Risdal, Porsgrunn (NO)

(73) Assignee: Norsk Hydro ASA, Oslo (NO)

( * ) Notice: Subject to any disclaimer, the term of this patent is extended or adjusted under 35 U.S.C. 154(b) by 453 days.

This patent is subject to a terminal disclaimer.

(21) Appl. No.: 10/468,830

(22) PCT Filed: Feb. 13, 2002

(86) PCT No.: PCT/NO02/00061

§ 371 (c)(1),
(2), (4) Date: Nov. 5, 2003

(87) PCT Pub. No.: WO02/066710

PCT Pub. Date: Aug. 29, 2002

(65) Prior Publication Data

US 2004/0094429 A1 May 20, 2004

(30) Foreign Application Priority Data

Feb. 23, 2001 (NO) ..... 20010928

(51) Int. Cl.
*C25B 11/04* (2006.01)

(52) U.S. Cl. ..... 204/291; 204/243.1; 423/594.1; 423/594.3; 423/595; 423/598; 423/594.9; 205/384; 205/385

(58) Field of Classification Search ..... 205/384, 205/385; 204/291, 283, 284, 243.1; 423/594.1, 423/594.3, 595, 598, 599, 594.9
See application file for complete search history.

(56) References Cited

U.S. PATENT DOCUMENTS

| | | | | |
|---|---|---|---|---|
| 4,039,401 | A | 8/1977 | Yamada et al. | 204/67 |
| 4,397,729 | A | 8/1983 | Duruz et al. | 204/243.1 |
| 4,614,569 | A | 9/1986 | Duruz et al. | 204/67 |
| 6,083,362 | A | 7/2000 | Hryn et al. | 204/290 R |
| 2004/0245096 | A1* | 12/2004 | Julsrud et al. | 204/290.01 |

* cited by examiner

*Primary Examiner*—Bruce F. Bell
(74) *Attorney, Agent, or Firm*—Wenderoth, Lind & Ponack, L.L.P.

(57) ABSTRACT

A material suitable for use as the active anode surface in the electrolytic reduction of alumina to aluminium metal defined by the formula: $A_{1+x}B_{1+\delta}C_dO_4$ where A is a divalent cation or a mixture of cations with a relative preference for octahedral coordination, B is a trivalent cation or mixture of cations with a relative preference for tetrahedral coordination, C is a trivalent cations with a relative preference for octahedral coordination or a four-valent cation with a relative preference for octahedral coordination, O is the element oxygen: When C is trivalent $x=0$, $0.8<d<1$, $\delta<0.2$ and $x+d+d$ is essentially equal to 1. When C is four-valent $0.4<x<0.6$, $0.4<d<0.6$, $\delta<0.2$ and $x+d+\delta$ is essentially equal to 1.

20 Claims, 3 Drawing Sheets

MATERIAL FOR A DIMENSIONALLY STABLE ANODE FOR THE ELECTROWINNING OF ALUMINUM

FIELD OF INVENTION

Figure 1:
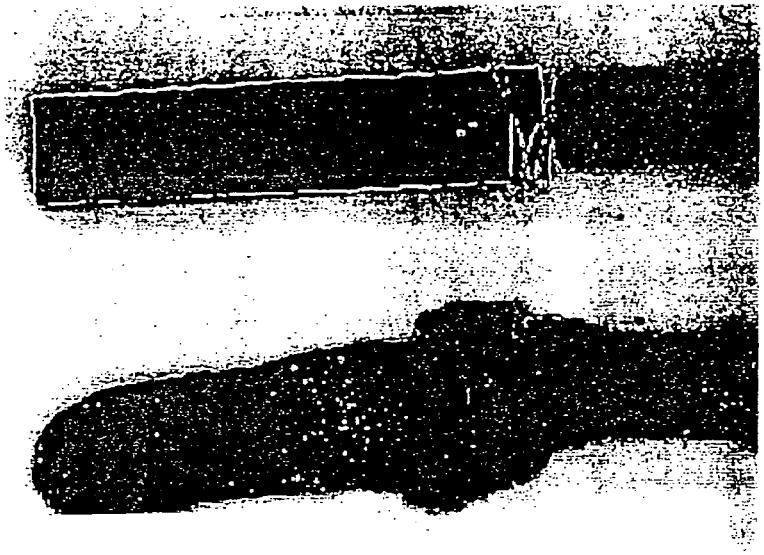

The present invention relates to a material that can act as the active anode surface layer of a dimensionally stable anode for the electrolysis of alumina dissolved in a fluoride containing molten salt bath.

BACKGROUND ART

Conventionally, aluminium is produced by the electrolysis of alumina dissolved in a cryolite based molten salt bath by the more than hundred years old Hall-Heroult process. In this process carbon electrodes are used, where the carbon anode is taking part in the cell reaction resulting in the simultaneous production of $CO_2$. The gross consumption of the anode is up to 550 kg/ton of aluminium produced, causing emissions of greenhouse gases like fluorocarbon compounds in addition to $CO_2$. For both cost and environmental reasons the replacement of carbon anodes with an effectively inert material would be highly advantageous. The electrolysis cell would then produce oxygen and aluminium.

Such an anode will, however, be subject to extreme conditions and will have to fulfil very severe requirements. The anode will simultaneously be subjected to around 1 bar of oxygen pressure at high temperature, the very corrosive molten salt bath specifically designed to be a solvent for oxides, and a high aluminium oxide activity. The corrosion rate must be low enough so that a reasonable time between anode changes is achievable, as well as the corrosion products must not adversely affect the quality requirements of the produced aluminium. The first criterion would mean a corrosion rate not higher than a few millimeters per year, while the second is very dependent on the elements involved, from as high as 2000 ppm for Fe to only a few tens ppm or lower for elements like Sn to fulfil today's requirements for top quality commercial aluminium.

Many attempts have been made to develop inert anodes. The work can be divided into three main approaches; a ceramic material doped to sufficient electronic conductivity, a two or more phase ceramic/metal composite or a metal alloy anode.

Many of the compounds in the first group that much work later have been focused on, were first studied in this context by Belyaev and Studentsov (Legkie Metal.6, No.3, 17–24 (1937)) a.o. $Fe_3O_4$, $SnO_2$, $Co_3O_4$ and NiO and Belyaev (Legkie Metal.7, No.1,7–20(1938)) a.o. $ZnFe_2O_4$, $NiFe_2O_4$.

Later examples from the first group are anodes based on $SnO_2$ doped with e.g. $Fe_2O_3$, $Sb_2O_3$ or $MnO_2$ documented in U.S. Pat. No. 4,233,148 (electrodes with up to 79 wt % $SnO_2$) and U.S. Pat. No. 3,718,550 (electrodes with more than 80 wt % $SnO_2$). Sn impurities in the produced aluminium do, however, strongly impair the properties of the metal even at very low concentrations and so render an anode based on $SnO_2$ impractical.

Further, in EP0030834A3 doped spinels are described, with a chemical composition based on the formula $M_I M_{II3-x}O_4 \cdot yM_{III}^{b+}O_{n/2}$ where $M_I$ is a divalent metal a.o. Ni, Mg, Cu and Zn, while $M_{II}$ is one or more divalent/trivalent metals from the group Ni, Co, Mn and Fe, and $M_{III}$ is one or more from a large group of 4- , 3-, 2- and monovalent metals.

Other examples are the range of spinel and perovskite materials described in U.S. Pat. Nos. 4,039,401 and 4,173,518 of which, however, none have proven practical for use in an aluminium electrolysis cell. This is partly because of limited corrosion resistance and partly because of low electronic conductivity.

In U.S. Pat. Nos. 4,374,050 and 4,478,693 is disclosed a generic formula describing compositions of possible anode materials. The formula would cover practically all combinations of oxides, carbides, nitrides, sulfides and fluorides of virtually all elements of the periodic table. The examples concentrate on various stoichiometric and nonstoichiometric oxides of the spinel structure. None of these have proven practical, presumably because of limited stability towards dissolution and low electronic conductivity. In U.S. Pat. No. 4,399,008 a material is described consisting of two oxide phases of which one is a compound of two oxides and the other a pure phase of one of the component oxides.

As the low electronic conductivity of the anode materials has been a problem, a number of efforts have been documented where the aim has been to combine an inert material with an interwoven matrix of a metallic phase. This is the second group mentioned above. General examples are U.S. Pat. Nos. 4,374,761 and 4,397,729. In U.S. Pat. No. 4,374,761 the compositions of the aforementioned U.S. Pat. No. 4,374,050 are described as the ceramic part of a cermet with a metallic phase that can consist of a range of elements. An example from the extensive work carried out on the cermet anodes based on the spinel $NiFe_2O_4$ with a Cu or Ni based metal phase is U.S. Pat. No. 4,871,437 describing a production method for making electrodes with a dispersed metal phase. In U.S. Pat. No. 5,865,980 the metal phase is an alloy of copper and silver. The apparent problems with these materials are partly corrosion of the ceramic phase, and partly oxidation and subsequent dissolution of the metal phase under process conditions.

The third group is exemplified by a number of patents on alloys and alloy configurations. The advantage is the high electronic conductivity and the attractive mechanical properties, but common to all metals and metal alloys is, however, that none except the noble metals will be stable towards oxidation under working anode conditions. Different avenues to solve this problem have been followed. U.S. Pat. No. 5,069,771 discloses a method comprising the in-situ formation of a protecting layer made from a cerium oxyfluoride that is generated and maintained by the oxidation of cerium fluoride dissolved in the electrolyte. This technology was first described in U.S. Pat. No. 4,614,569, also for use with ceramic and cermet anodes, but in spite of extensive development work it has so far not found commercial application. One problem is that the produced metal will contain cerium impurities, and thus requires an extra purification process step.

In U.S. Pat. No. 4,620,905 a metal anode that will form a protective layer by in situ oxidation is described. Similarly, U.S. Pat. No. 5,284,562 describes alloy compositions based on copper, nickel and iron where the oxide formed creates a layer that is protective towards further oxidation. International applications WO 00/06800, WO 00/06802, WO 00/06804, WO 00/6805 describe variations of very similar approaches. In U.S. Pat. No. 6,083,362 an anode is described where the protective layer is formed by the oxidation of aluminium on the surface of the anode, the layer being thin enough to still have acceptable electrical conductivity, and being replenished by the diffusion of aluminium through the metal anode from a reservoir in the anode.

Common to all these suggestions is, however, that none offers fully satisfactory solutions to the problem that metals or metal alloys except the noble metals will oxidize under working anode conditions. The formed oxide will gradually dissolve in the electrolyte, the rate of dissolution depending on the oxide formed. In some cases this leads to build-up of oxide layers resulting in low electrical conductivity and high cell voltage, and in other cases gives spalling and excessive corrosion of the anode. In the ideal case the oxide is formed at the same rate as it is dissolved, the rate not being too high for a reasonable lifetime of the anode and causing unacceptable concentrations of impurities in the produced metal. No such system has been demonstrated.

OBJECT OF THE INVENTION

The object of the present invention is to identify a material that has a sufficiently low solubility in the electrolyte, stablility towards reaction with alumina in the electrolyte, low ionic conductivity and sufficient electronic conductivity to be the electrochemically active anode in a practical inert anode aluminium electrolysis cell.

SUMMARY OF THE INVENTION

The invention is the conclusion of an extensive search for materials capable of fulfilling the strict requirements for an inert anode material. Assuming a temperature higher than 850° C. and 1 bar $O_2$ at the anode, all elements except the noble metals will form oxides. A systematic survey of the properties of all the elements and oxides of the elements concluded that based on the requirements mentioned above, an inert anode material can only be made from the following element oxides: $TiO_2$, $Cr_2O_3$, $Fe_2O_3$, $Mn_2O_3$, CoO, NiO, CuO, ZnO, $Al_2O_3$, $Ga_2O_3$, $ZrO_2$, $SnO_2$ and $HfO_2$. For one or several of the following reasons: low electronic conductivity, formation of insulating aluminate compounds or high solubility in the electrolyte, none of these will be practical as single oxides.

An anode can thus be constructed only from a compound offering the required properties. The compound should contain one oxide with low solubility, and at least one more oxide that supplies electronic conductivity with the compound being stable enough to limit the solubility of the second component sufficiently and to prevent formation of insulating aluminate phases by exchange reactions. This is accomplished by taking into account the varying stability of the transition metal elements in varying coordination.

The combined evaluation leads to a spinel compound of composition $Ni_{1+x}(B_{1+\delta}C_d)O_4$ where Ni is the element nickel, B is a trivalent element that prefers tetrahedral coordination, preferably Fe. C is either a trivalent cation preferring octahedral coordination like Cr or a tetravalent cation preferring octahedral coordination like Ti or Sn. O is the element oxygen. $0.4<x<0.6$, $0.4<d<0.6$ and $\delta<0.2$ and $x+\delta+d=1$ when C is tetravalent. When C is trivalent x is essentially 0, $0.8<d<1.2$, $\delta<0.2$ and $x+d+\delta=1$. This compound will have superior properties compared to previously explored compositions

DETAILED DESCRIPTION OF THE INVENTION

A material suitable as an essentially inert electrode for the electrolytic production of aluminium from alumina dissolved in an essentially fluoride based electrolyte where cryolite is an important ingredient, must fulfil a range of very strict requirements. The material must have a sufficient electronic conductivity, be resistant to oxidation, be resistant to corrosive attacks by the electrolyte of which one can think of formation of insulating aluminate surface layers by the reaction of the anode material with dissolved alumina, as well as dissolution in the electrolyte. A selection of the element oxides which an electrode can consist of, was performed based on the following criteria:

- not a gas or having a high vapour pressure at process temperature
- not converted by cryolite or $AlF_3$ in the cryolitic mixture, i.e. a large positive value of $\Delta G°$ for the reaction between the element oxide and $AlF_3$ to form the element fluoride and aluminium oxide (1).

$$MO_x+2x/3AlF_3=MF_{2x}+2x/6Al_2O_3 \quad (1)$$

- not converted by alumina, i.e. not a negative value of $\Delta G°$ for the reaction between the element oxide aluminium oxide and sodium fluoride to form a sodium element oxide and aluminium fluoride (2)

$$MO_x+6yNaF+yAl_2O_3=Na_{6y}MO_{x+3y}+2yAlF_3 \quad (2)$$

Of elements with the normal valence 2, possible elements thus are the elements Co, Ni, Cu and Zn. Of elements with valence 3 one is left with only the elements Cr, Mn, Fe, Ga and Al. Of elements with valence 4 one is left with only the elements Ti, Zr, Hf, Ge and Sn.

Of these, the tri and tetravalent elements will have higher solubility than the divalent elements at high aluminium oxide activity in the fluoride based electrolyte. Of the divalent element oxides, NiO and CoO have the lowest solubility, and will be the best choice with respect to corrosion resistance. Pure NiO and CoO do, however, have low electronic conductivity, and dopants like $Li_2O$ that will increase the conductivity, will rapidly dissolve in the electrolyte leaving a surface layer with high resistance. Pure CoO is moreover unstable with respect to formation of the spinel $Co_3O_4$ under anodic conditions, and this compound will again gradually react with aluminium oxide to form $Co(Al_xCo_{1-x})_2O_4$ where $x>0$ and eventually $CoAl_2O_4$ when the activity of aluminium oxide is high. Pure NiO will form $NiAl_2O_4$, a compound with very low electronic conductivity, at high alumina activities. This is further illustrated in Example 5.

CuO has too high solubility, while ZnO has too high solubility at low alumina activity, and forms an insulating aluminate at high alumina activities. Tests with ZnO are illustrated in Example 6.

The essence of the present invention is the combination of elements to maintain low solubility with acceptable electronic conductivity. Compounds of different element oxides with the same valence will not offer enough stability to make a difference. This calls for a combination of element oxides with different valencies forming a crystalline compound with the required properties. Compounds of di and trivalent oxides will in this case be of the spinel structure. As stated above, spinels like $NiFe_2O_4$, $CoFe_2O_4$, $NiCr_2O_4$ and $CoCr_2O_4$ have been suggested and extensively tested as candidates for inert anodes. The problems are mainly connected to solubility and reaction with aluminium oxide forming aluminates with low electronic conductivity. This is further illustrated in examples 3 and 10.

Compounds of di and tetravalent element oxides can form a.o. ilmenite and perovskite structures in addition to the olivine based structures known for silicates. With the element oxides presented above, only the ilmenite structure ($NiTiO_3$,$CoTiO_3$) and spinel structure ($Zn_2SnO_4$) are relevant. Of these $NiTiO_3$ would have the best potential from a stability viewpoint, but the electronic conductivity is too low to offer a potential as an inert anode material. The $Zn_2SnO_4$ suffers from low stability towards aluminium oxide and as can be inferred from the background art discussion, it would probably cause high contamination of Sn in the produced metal.

One is then left with the question if the di and trivalent spinels can be improved.

The spinel structure is built up from a cubic close packed array of oxide ions with cations occupying ⅛ of the tetrahedral sites and ½ of the octahedral sites. When the tetrahedral sites are occupied by the divalent cations, and the octahedral sites by the trivalent cations, the structure is called a "normal" spinel. When, on the other hand, half of the cations on the octahedral sites are divalent, and the cations on the tetrahedral sites are trivalent, the structure is called an "inverse" spinel.

It is known that the different transition metals will have a varying preference for coordination geometry dependent on a.o. the number of d-electrons (H. J. Emeleus and A. G. Sharpe, "Modern Aspects of Inorganic Chemistry" Routledge & Kegan Paul, London 1978). In two publications by A. Navrotsky and O. J. Kleppa (J. inorg. nucl. Chem. 29(1967)2701 and 30(1968)479) the effects on the thermodynamics of spinels are discussed. It is known that trivalent Fe has a preference for tetrahedral coordination while divalent Ni has a preference for octahedral positions. This causes nickel ferrite to posses an essentially inverse spinel structure. All the ferrites of the divalent elements in question posses the inverse spinel structure except the Zn analogue which forms a normal spinel. The aluminates form a partially inverse structure depending on the divalent cation's preference for octahedral coordination. Nickel forms the strongest inverse, while Zn is normal. The chromites are all normal except for nickel chromite, which is partially inverse. To sum up, the preference for octahedral coordination among the divalent cations in question is: Ni>Cu>Co>Zn, and for trivalent cations Cr>Mn>Al>Ga>Fe. The tetravalent cations will all have a preference for octahedral coordination.

The essence of the present invention is to utilize this in order to construct an anode material with improved stability while maintaining the electronic conductivity.

The most stable spinel can then be constructed from a combination of divalent, trivalent and tetravalent oxides where each components' preference for coordination is satiated. $NiFe_2O_4$ is as mentioned one of the most studied candidate materials. NiO has a low solubility and preference for octahedral coordination while trivalent Fe has a preference for tetrahedral cooordination. In the compound Fe is, however, also found in octahedral coordination rendering the compound susceptible to exchange reactions with dissolved alumina. As illustrated in Example 3 this will adversely affect the electronic conductivity.

The stability can be improved by substituting half of the trivalent Fe with a trivalent cation with a strong preference for octahedral coordination. This would suggest the compound $ABCO_4$ where A is a divalent cation with a preference for octahedral coordination, preferably Ni, B is a trivalent cation with a preference for octahedral coordination, preferably Cr or Mn, C is a trivalent cation with a preference for tetrahedral coordination, preferably Fe as trivalent ion and O is oxygen. In Examples 2 and 8 a material is tested where B is Cr. Example 8 shows that the improvement was not sufficient to completely prevent the formation of a reaction layer.

Another possibility is to substitute half the iron with a divalent metal with a preference for octahedral coordination and a tetravalent metal in a ratio to ensure near stoichiometry of the compound. The combination of the divalent cations with strong preference for octahedral coordination and the trivalent cation with the strongest preference for tetrahedral coordination and a tetravalent cation would suggest the stoichiometry $A_{1+x}(B_{1+\delta}C_d)O_4$ where A is Ni, B is Fe and C is Ti or Sn. Elements like Zr and Hf are too large to enter the structure to any large degree. In Examples 1, 2 and 9 a compound where C is Ti is tested, and Example 9 shows that the formation of an alumina containing reaction layer during electrolysis was avoided.

Figure 2:
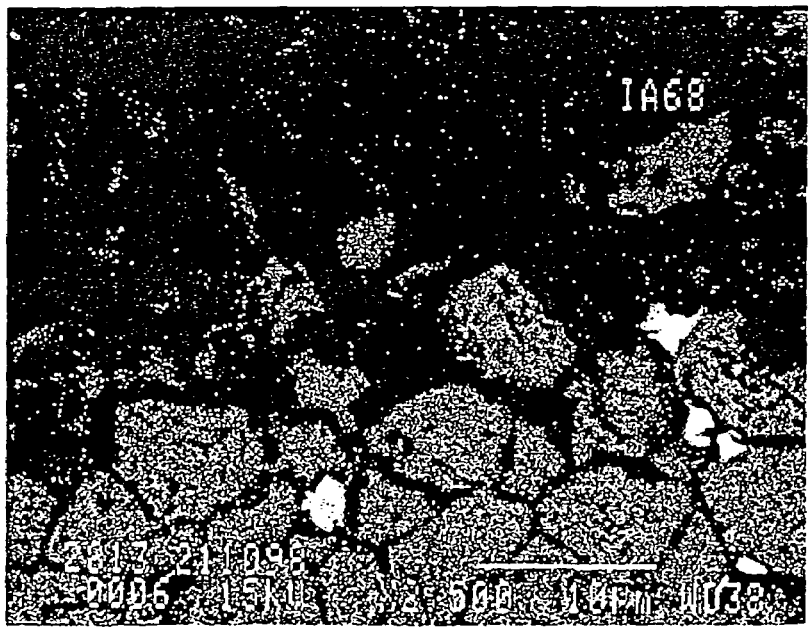
Figure 3:
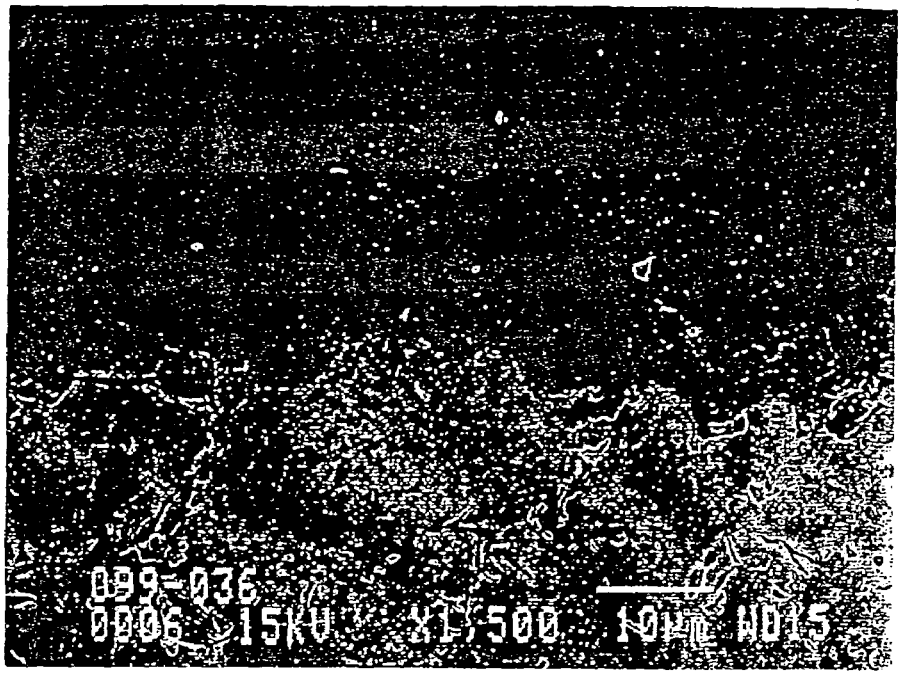
Figure 4:
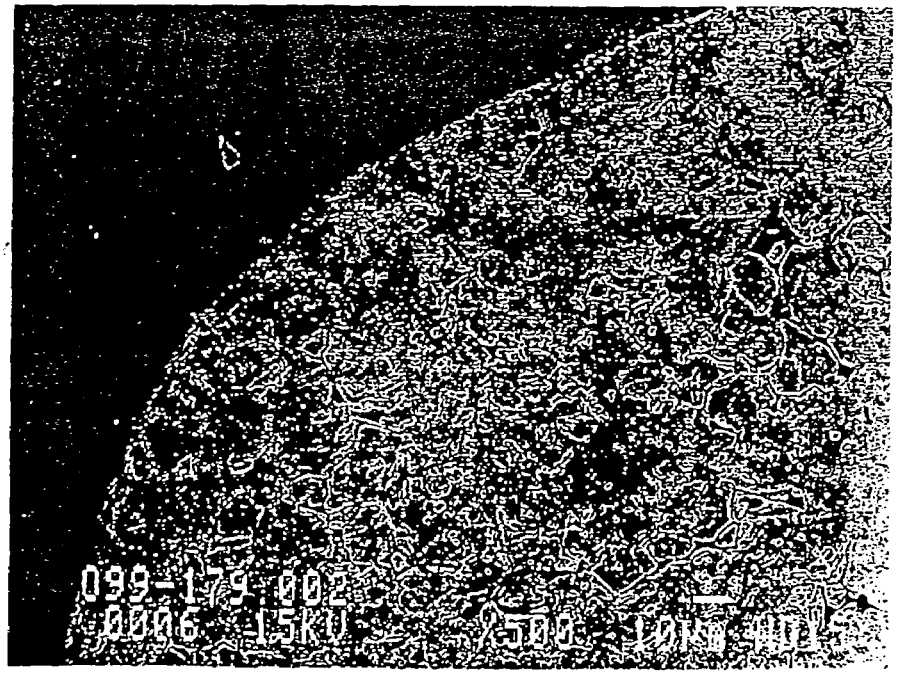
Figure 5:
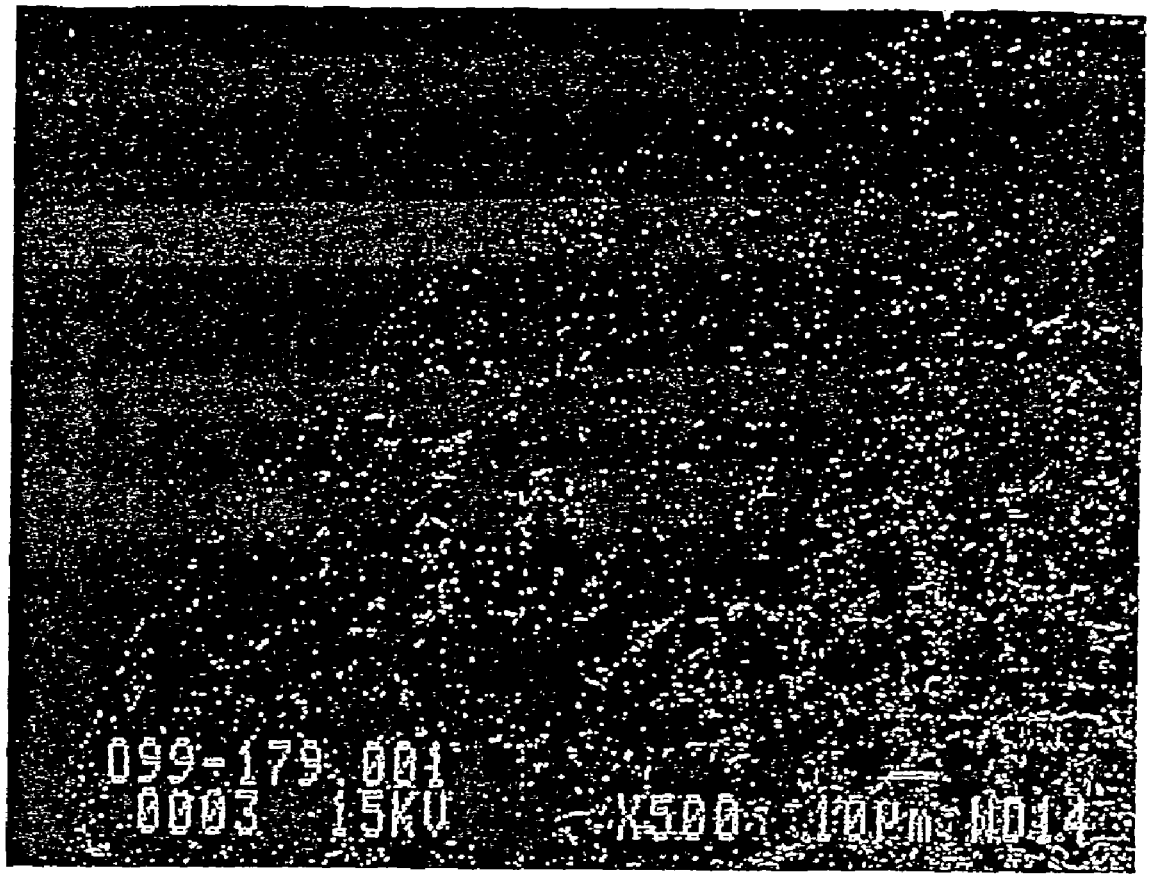

The invention shall in the following be further described by figures and examples where:

FIG. 1 shows a photograph of a working anode before and after the electrolysis of example 7, FIG. 2 shows a backscatter SEM photograph of the reaction zone of a $Ni_{1.1}Cr_2O_4$ material after 50 hours of electrolysis, FIG. 3 shows a backscatter SEM photograph of a $NiFeCrO_4$ anode after 50 hours electrolysis, FIG. 4 shows a backscatter SEM photograph of an anode material after the electrolysis experiment of Example 9, FIG. 5 shows a backscatter SEM photograph of a $Ni_{1.01}Fe_2O_4$ anode after 30 hours electrolysis.

EXAMPLE 1

Electrical Conductivity Measurements of $Ni_{1.5+2x}FeTi_{0.5+x}O_{4+4x}$ and $Ni_{1.5+x}Fe_{1+2x}Ti_{0.5}O_{4+4x}$ Materials The powder was prepared by a soft chemistry route. For each synthesis the appropriate $Ni(NO_3)_2$, $Fe(NO_3)_3$, $Cr(NO_3)_3$, $Al(NO_3)_3$ and $TiO_5H_{14}C_{10}$ were complexed with citric acid in water. In some cases Ni or Fe was dissolved in $HNO_3$ as starting solution. After evaporation of excess water, the mixture was pyrolysed and calcined. The calcination was normally performed at 900° C. for 10 hours. The samples were either uniaxially pressed at approximately 100 MPa or they were cold isostatically pressed at 200 MPa. The sintering temperature was normally in the range 1300° C.–1500° C. with a holding time for 3 hours. All the materials were characterized by XRD as spinel type structures.

The total electrical conductivity was measured in air by a 4-point van der Pauw dc-measurements method (ref.: van der Pauw, L. J., Phillips Res. Repts. 13 (1), 1958; and Poulsen, F. N., Buitink, P. and Malmgren-Hansen, B.—Second International Symposium on solid oxide fuel cells, Jul. 2–5, 1995—Athens.). The samples were discs with a diameter of approximately 25 mm and a thickness lower than 2.5 mm. Four contacts were made to the circumference of the sample with a droplet of platinum paste. After sintering, the density of the samples were measured using the Archimedean method in isopropanol. The densities varied between 84 and 97% of theoretical. The total electrical conductivity was corrected for porosity using the relation:

$$\sigma_{dense}=\sigma_{porous}/(1\text{-porosity})^2$$

The table below shows the results for $Ni_{1.5}FeTi_{0.5}O_4$ with excess $NiFe_2O_4$ (x $NiFe_2O_4$) and excess "$Ni_2TiO_4$" (x $Ni_2TiO_4$) where x=0, 0.01, 0.02 and 0.03.

| Composition: | x | $\sigma_{dense}$ at 850° C. (S/cm) | $\sigma_{dense}$ at 900° C. (S/cm) |
|---|---|---|---|
| $Ni_{1.53}Fe_{1.06}Ti_{0.5}O_{4.12}$ | 0.03 | 1.69 | 1.94 |
| $Ni_{1.52}Fe_{1.04}Ti_{0.5}O_{4.08}$ | 0.02 | 1.59 | 1.80 |
| $Ni_{1.51}Fe_{1.02}Ti_{0.5}O_{4.04}$ | 0.01 | 1.83 | 2.08 |
| $Ni_{1.5}FeTi_{0.5}O_4$ | 0 | 0.35 | 0.43 |
| $Ni_{1.52}FeTi_{0.51}O_{4.04}$ | 0.01 | 0.06 | 0.08 |
| $Ni_{1.54}FeTi_{0.52}O_{4.08}$ | 0.02 | 0.07 | 0.10 |
| $Ni_{1.56}FeTi_{0.53}O_{4.12}$ | 0.03 | 0.04 | 0.07 |

The results show that the electrical conductivity for materials with excess $NiFe_2O_4$, or $Ni_{1.5+x}Fe_{1+2x}Ti_{0.5}O_{4+4x}$ where x>0, is higher than the stoichiometric material. Materials of $Ni_{1.5}FeTi_{0.5}O_4$ with excess "$Ni_2TiO_4$", or $Ni_{1.5+2x}FeTi_{0.5+x}O_{4+4x}$ where x>0, have lower electrical conductivity than the stoichiometric material. It is advantageous, in order to optimize the electrical conductivity, to make the material with a slight $NiFe_2O_4$ excess.

EXAMPLE 2

Electrical Conductivity Measurements of $Ni_{1+x}Cr_2O_4$, $NiFeCrO_4$ and $Ni_{1.5+x}FeTi_{0.5-x}O_4$ Materials Samples with the shape of a rod from the following compositions, all with excess Ni: $NiCr_2O_4$, $NiFeCrO_4$ and $Ni_{1.5+x}FeTi_{0.5-x}O_4$ were prepared as previously described in Example 1. All the materials were characterized by XRD as spinel type structures. In this experiment the total electrical conductivity was measured in air by 4-point dc-measurements. Current carrying wires made from platinum were connected to the ends of the rod with platinum paste. Platinum wire were connected to the rod in the same way for measuring the voltage. The samples were rods with a length of approximately 28 mm and a cross-sectional area of 4 mm×6 mm. The total electrical conductivity for dense samples was calculated as described in Example 1. The table below shows the results for the total electrical conductivity corrected for porosity:

| Composition: | $\sigma_{dense}$ at 850° C. (S/cm) | $\sigma_{dense}$ at 900° C. (S/cm) |
|---|---|---|
| $Ni_{1.1}Cr_2O_4$ | 3.20 | 3.47 |
| $NiFeCrO_4$ | 0.71 | 0.83 |
| $Ni_{1.53}FeTi_{0.47}O_4$ | 1.01 | 1.17 |

The experiment shows that the total electrical conductivity of $Ni_{1.1}Cr_2O_4$ is higher than for $NiFeCrO_4$. For the $Ni_{1.5+x}FeTi_{0.5-x}O_4$ where x=0.03 ($Ni_{1.53}FeTi_{0.47}O_4$) the electrical conductivity was higher than for the $NiFeCrO_4$ material.

EXAMPLE 3

Electrical Conductivity of $Ni_{1.01}Fe_2O_4$ and $NiFe_{2-x}Al_xO_4$ Materials

The synthesis of the powder and preparation of samples were done in the same way as described in Example 1. $NiFe_2O_4$ with excess Ni is compared to a material where Fe is partially substituted with Al. All the materials were characterized by XRD as spinel type structures. The total electrical conductivity was measured as described in Example 2. The corrected value for dense samples are reported in the table below:

| Composition: | $\sigma_{dense}$ at 850° C. (S/cm) | $\sigma_{dense}$ at 900° C. (S/cm) |
|---|---|---|
| $Ni_{1.01}Fe_2O_4$ | 1.45 | 1.93 |
| $NiFeAlO_4$ | 0.03 | 0.03 |
| $NiFe_{1.1}Al_{0.9}O_4$ | 0.03 | 0.04 |
| $NiFe_{1.3}Al_{0.7}O_4$ | 0.06 | 0.09 |

The total electrical conductivity of the $NiFe_2O_4$ material with a slight excess of Ni ($Ni_{1.01}Fe_2O_4$) is measured to be 1.93 S/cm at 900° C. With increasing amount of Al in the structure, the total electrical conductivity decreases considerably, showing that exchange of Fe with Al will have detrimental effects if the material was used as an anode in a cell for production of Al.

EXAMPLE 4

Electrical Conductivity of $Ni_{1.52}FeSn_{0.48}O_4$ Materials

The synthesis of the powder and preparation of samples were carried out in the way described in Example 1. The Sn source was tin(II)acetate. The material was characterized with XRD as a spinel type structure after sintering. The total electrical conductivity was measured as described in Example 2 and was corrected for porosity as described in Example 1. The table below shows the results for the total electrical conductivity:

| Composition: | $\sigma_{dense}$ at 850° C. (S/cm) | $\sigma_{dense}$ at 900° C. (S/cm) |
|---|---|---|
| $Ni_{1.52}FeSn_{0.48}O_4$ | 1.06 | 1.23 |

The total electrical conductivity was measured to be 1.23 S/cm at 900° C., which is in the same range as as for the titanium analogue (see Example 2).

EXAMPLE 5

Electrolysis of Alumina with NiO Anode Material

NiO has too low electronic conductivity to operate as a working anode. A cermet with 25 wt % Ni and the rest NiO gave a metal network throughout the ceramic, and thereby metallic conductivity. As Ni source was used INCO Ni powder type 210, and NiO from Merck, Darmstadt. The material was sintered in argon atmosphere at 1400° C. for 30 min.

The electrolysis cell was made up of an alumina crucible with inner diameter 80 mm and height 150 mm. An outer alumina container with height 200 mm was used for safety, and the cell was covered with a lid made from high alumina cement. In the bottom of the crucible a 5 mm thick $TiB_2$ disc was placed, which made the liquid aluminium cathode stay horizontal and created a well defined cathode area. The electrical connection to the cathode was provided by a $TiB_2$ rod supported by an alumina tube to avoid oxidation. A platinum wire provided electrical connection to the $TiB_2$ cathode rod. A Ni wire provided for the electrical connection to the anode. The Ni wire and the anode above the electrolyte bath was masked with an alumina tube and alumina cement to prevent oxidation.

The electrolyte was made by adding into the alumina crucible a mixture of:

532 g $Na_3AlF_6$ (Greenland cryolite)

105 g $AlF_3$ (from Norzink, with about 10% $Al_2O_3$)

35 g $Al_2O_3$ (annealed at 1200° C. for some hours)

21 g $CaF_2$ (Fluka p.a.)

In the bottom of the alumina crucible 340 g Al, pure, from Hydro Aluminium was placed.

The anode was hanging under the lid while the electrolyte was melting. When the electrolysis experiment started, the anode was dipped into the electrolyte. The temperature was 970° C. and was stable during the whole experiment. The anodic current density was set to 750 mA/cm$^2$ based on the end cross sectional aera of the anode. The real anodic current density was somewhat lower because the side surfaces of the anode were also dipped into in the electrolyte.

The electrolysis experiment lasted for 8 hours. During the electrolysis the cell voltage increased continuously. XRD (X-ray diffraction) analysis of the anode after the electrolysis experiment showed that the Ni metal was oxidized to NiO and the anode material was covered by an insulating layer of $NiAl_2O_4$.

Doping the NiO phase with 4 mol % Li as $Li_2O$ to increase the conductivity of the ceramic to 22 S/cm at 900° C., prolonged the electrolysis time to approximately 30 hours. The Li dopant was gradually washed out and thereby the electrical conductivity was reduced. No Li could be detected with atomic absorption spectrometry analysis at the interior of the anode after the experiment. Also in this case the anode was covered with an insulating $NiAl_2O_4$ layer.

EXAMPLE 6

Electrolysis of Alumina with ZnO Anode Material

Pure ZnO has too low electronic conductivity and was therefore doped with 0.5 mol % $AlO_{1.5}$ to give a conductivity of 250–300 S/cm$^2$ at 900° C. Two Pt wires were pressed into the material in the longitudinal axis of the ZnO anode and acted as electrical conductors. The material was sintered at 1300° C. for 1 hour.

The electrolysis experiment was performed in the same manner as described in Example 5. The amounts of electrolyte and aluminium were the same. The temperature was 970° C. The current density was set to 1000 mA/cm$^2$ based on the end cross sectional area of the anode. The electrolysis experiment lasted for 24 hours. XRD (X-ray diffraction) analysis of the anode material after the electrolysis experiment showed that ZnO had been converted to porous $ZnAl_2O_4$ during electrolysis. There was only a small piece of original ZnO material left in the inner core of the soaked ZnO anode.

EXAMPLE 7

Electrolysis of Alumina with $Ni_{1+x}Cr_2O_4$ Anode Material

The anode material was synthesized and sintered as described in Example 1. The electrolysis experiment was performed in the same manner as described in Example 5, but a platinum wire provided electrical connection to the working anode. The platinum wire to the anode was protected by a 5 mm alumina tube. When the electrolysis started the anode was dipped approximately 1 cm into the electrolyte. A photograph of the working anode before and after electrolysis is shown in FIG. 1. Some platinum paste was used to provide a good electrical contact between the anode and the platinum wire.

The electrolyte, temperature and anodic current density were the same as described in Example 6.

The electrolysis experiment lasted for 50 hours. After the experiment the anode was cut, polished and examined in SEM (Scanning Electron Microscope). A reaction zone could be seen between the $Ni_{1.1}Cr_2O_4$— material and the electrolyte. FIG. 2 shows the backscatter SEM photograph of the reaction zone. On the photograph one can see penetration of a reaction zone in the grain boundaries of the $Ni_{1.1}Cr_2O_4$— material. The white particles are NiO.

In the table below the relative EDS analysis results are reported. Elements from the electrolyte were not detected and except for Ni, Cr and Al only O was detected. The aluminium present in the inner of the grains might be due to the preparation of the sample for analysis.

Relative comparison between the elements Ni, Cr and Al:

| Element: | Atom % in the centre of the grains in FIG. 2: | Atom % in the reaction zone in grain boundaries in FIG. 2: |
|---|---|---|
| Ni | 33 | 47 |
| Cr | 66 | 8 |
| Al | 1 | 45 |

From the SEM analysis it turned out that the reaction product consisted of a material where the chromium atoms were partly exchanged with aluminium atoms as described by the formula $NiCr_{2-x}Al_xO_4$ where x varies from 0 to 2.

EXAMPLE 8

Electrolysis of Alumina with $NiFeCrO_4$ Anode Material

The electrolysis experiment was performed in the same manner as described in Example 7. The amounts of electrolyte and aluminium were the same. The current density was set to 1000 mA/cm$^2$ based on the cross sectional area of the rectangular anode. The experiment lasted for 50 hours. Examinaton of the anode after the electrolysis showed a several micron thick reaction layer where Cr in the material was partly exchanged with Al atoms. A backscatter SEM photograph of the reaction layer is shown in FIG. 3. Light grey areas consist of original $NiFeCrO_4$ material. Medium grey area contains almost no Cr atoms and a much lower content of Fe.

EDS analysis of the medium grey reaction layer shown in FIG. 3 compared to original $NiFeCrO_4$ material and the inner of the anode light grey area also shown in FIG. 3 are summarized in table below. The only elements detected were Ni, Cr, Fe, Al and O.

Comparison of the relative amounts of Cr, Fe, Ni and Al:

| Element: | Atom % in the original $NiFeCrO_4$ material. Light grey area in FIG. 3. | Atom % in the reaction layer after the test. Medium grey area in FIG. 3. |
|---|---|---|
| Cr | 33.3 | 0 |
| Fe | 33.3 | 16 |
| Ni | 33.3 | 35 |
| Al | 0 | 49 |

The conclusion of the electrolysis experiment is that the $NiFeCrO_4$ material reacts with alumina in the electrolyte and forms a reaction product of the type $NiFe_{1-x}Al_{1+x}O_4$. As shown in example 3 the electrical conductivity of $NiFe_{1+x}Al_{1-x}O_4$ material is very low and therefore also explains the increase in cell voltage.

EXAMPLE 9

Electrolysis of Alumina with $Ni_{1.5+x}FeTi_{0.5-x}O_4$ Anode Material

The electrolysis experiment was performed in the same manner as described in Example 7. The amounts of electrolyte and aluminium were the same. The current density was set to 1000 mA/cm$^2$ based on the cross sectional area of the rectangular anode. The experiment lasted for 30 hours. After the experiment the anode was cut, polished and examined in SEM. The backscatter photo in FIG. 4 discloses the end of the anode towards the cathode. There seems to be a rest of a reaction layer.some places, but analysis showed that this rest contains a residual of the electrolyte.

A line scan EDS analysis was done on a place where a reaction layer could be possible. The line scan indicates a thin layer of bath components on the anode. In this experiment there could not be detected any reaction layer on the $Ni_{1.5+x}FeTi_{0.5-x}O_4$ anode after 30 hours electrolysis.

EXAMPLE 10

Electrolysis of Alumina with $Ni_{1.01}Fe_2O_4$ Anode Material

The electrolysis experiment was performed in the same manner as described in Example 7. The amounts of electrolyte and aluminium were the same. The current density was set to 1000 mA/cm$^2$ based on the cross sectional area of the rectangular anode. The experiment was stopped after 30 hours. After the experiment the anode was cut, polished and examined in SEM. FIG. 5 discloses a backscatter photograph of the anode at the end towards the cathode. It can be seen an approximately 10 micron thick reaction layer.

A line scan EDS analysis was done to examine whether the layer was a reaction layer or adsorbed electrolyte. The line scan indicates a thin layer of bath components, and then a reaction layer of approximately 10 micron thickness. In the interior of the anode and in the reaction layer only oxygen was detected in addition to Ni, Fe and Al. The results are reported in the table below:

Comparison of the relative amounts of Ni, Fe and Al:

| Element: | Atom % of element in the interior of the anode shown in FIG. 5 and analysed with line scan EDS: | Atom % of element in the reaction layer as shown in FIG. 5 and analysed with line scan EDS: |
|---|---|---|
| Ni | 33 | 30 |
| Fe | 67 | 30 |
| Al | 0 | 40 |

In this experiment an approximately 10 micron thick reaction layer was formed. The iron atoms were partly exchanged with the aluminium atoms as described in the formula $NiFe_{2-x}Al_xO_4$ (or $Ni_{1-y}Fe_{2-x}Al_{x+y}O_4$)

The invention claimed is:

1. A material suitable for use as the active anode surface in a cell for electrolytic reduction of alumina to aluminium, the material having the formula $A_{1+x}B_{1+\delta}C_dO_4$ where:

A=a divalent cation or a mixture of divalent cations,

B=a trivalent cation or mixture of trivalent cations,

C=a trivalent cation or a mixture of trivalent cations,

O=the element oxygen wherein

A=have a relative preference for octahedral coordination,

B=have a relative preference for tetrahedral coordination,

C=have a relative preference for octahedral coordination where:

$x=0$, $0.8<d<1$, $\delta<0.2$ and $x+d+\delta$ is essentially equal to 1.

2. A material in accordance with claim 1, wherein the cation A is essentially divalent Ni.

3. A material in accordance with claim 1, wherein the cation B is essentially trivalent Fe.

4. A material in accordance with claim 1, wherein the cation C is essentially Cr or Mn or a mixture thereof.

5. A material in accordance with claim 1, wherein the cation C is essentially Ti or Sn or a mixture thereof.

6. A material in accordance with claim 1, wherein the cation A is essentially divalent Ni, and the cation B is essentially trivalent Fe and the cation C is essentially Ti.

7. A material in accordance with claim 1, wherein the cation A is essentially divalent Ni, and the cation B is essentially trivalent Fe and the cation C is essentially Sn.

8. A material in accordance with claim 1, wherein the cation A is essentially divalent Ni, and the cation B is essentially trivalent Fe and the cation C is essentially trivalent Cr.

9. A material in accordance with claim 1, wherein the cation A is essentially divalent Ni, and the cation B is essentially trivalent Fe and the cation C is essentially a mixture of Sn and Ti.

10. A material suitable for use as the active anode surface in a cell for electrolytic reduction of alumina to aluminium, the material having the formula $A_{1+x}B_{1+\delta}C_dO_4$ where:

A=a divalent cation or a mixture of divalent cations,

B=a trivalent cation or mixture of trivalent cations, wherein

A=have a relative preference for octahedral coordination,

B=have a relative preference for tetrahedral coordination,

C=a tetravalent cation or mixture of cations with a relative preference for octahedral coordination where:

$0.4<x<0.6$, $0.4<d<0.6$, $\delta<0.2$ and $x+d+\delta$ is essentially equal to 1, and O=the element oxygen.

11. A material in accordance with claim 10, wherein the cation A is essentially divalent Ni.

12. A material in accordance with claim 10, wherein the cation B is essentially trivalent Fe.

13. A material in accordance with claim 10, wherein the cation C is essentially Cr or Mn or a mixture thereof.

14. A material in accordance with claim 10, wherein the cation C is essentially Ti or Sn or a mixture thereof.

15. A material in accordance with claim 10, wherein the cation A is essentially divalent Ni, and the cation B is essentially trivalent Fe and the cation C is essentially Ti.

16. A material in accordance with claim 10, wherein the cation A is essentially divalent Ni, and the cation B is essentially trivalent Fe and the cation C is essentially Sn.

17. A material in accordance with claim 10, wherein the cation A is essentially divalent Ni, and the cation B is essentially trivalent Fe and the cation C is essentially trivalent Cr.

18. A material in accordance with claim 10, wherein the cation A is essentially divalent Ni, and the cation B is essentially trivalent Fe and the cation C is essentially a mixture of Sn and Ti.

19. An anode for the electrolysis of alumina dissolved in a fluoride based electrolyte, which comprises a supporting body and, supported thereon, a material suitable for use as the active anode surface in a cell for electrolytic reduction of alumina to aluminium, the material having the formula $A_{1+x}B_{1+\delta}C_dO_4$ where:

A=a divalent cation or a mixture of divalent cations,

B=a trivalent cation or mixture of trivalent cations,

C=a trivalent cation or a mixture of trivalent cations,

O=the element oxygen wherein

A=have a relative preference for octahedral coordination,

B=have a relative preference for tetrahedral coordination,

C=have a relative preference for octahedral coordination where:

$x=0$, $0.8<d<1$, $\delta<0.2$ and $x+d+\delta$ is essentially equal to 1.

20. An anode for the electrolysis of alumina dissolved in a fluoride based electrolyte, which comprises a supporting body and, supported thereon, a material suitable for use as the active anode surface in a cell for electrolytic reduction of alumina to aluminium, the material having the formula $A_{1+x}B_{1+\delta}C_dO_4$ where:

A=a divalent cation or a mixture of divalent cations,

B=a trivalent cation or mixture of trivalent cations, wherein

A=have a relative preference for octahedral coordination,

B=have a relative preference for tetrahedral coordination,

C=a tetravalent cation or mixture of cations with a relative preference for octahedral coordination where:

$0.4<x<0.6$, $0.4<d<0.6$, $\delta<0.2$ and $x+d+\delta$ is essentially equal to 1, and O=the element oxygen.

* * * * *